US006823988B2

(12) United States Patent
Ryan et al.

(10) Patent No.: US 6,823,988 B2
(45) Date of Patent: Nov. 30, 2004

(54) CONTAINER FOR HOUSING A PREMIUM

(75) Inventors: Michael Dennis Ryan, Drexel Hill, PA (US); Angela L. Rowland, Collegeville, PA (US); Felicia Ann Pinkstone, Boothwyn, PA (US)

(73) Assignee: Smurfit-Stone Container Corporation, Chicago, IL (US)

( * ) Notice: Subject to any disclaimer, the term of this patent is extended or adjusted under 35 U.S.C. 154(b) by 0 days.

(21) Appl. No.: 10/077,085

(22) Filed: Feb. 15, 2002

(65) Prior Publication Data

US 2003/0155270 A1 Aug. 21, 2003

(51) Int. Cl.[7] ..... B65D 77/00

(52) U.S. Cl. ..... 206/216; 206/579; 206/775; 206/779

(58) Field of Search ..... 206/216, 486, 206/490, 579, 730, 732, 733, 734, 775, 779; 229/120.14, 120.15, 162

(56) References Cited

U.S. PATENT DOCUMENTS

| | | | | |
|---|---|---|---|---|
| 1,585,783 | A | 5/1926 | Mason | |
| 1,670,498 | A | 5/1928 | Einson | |
| 1,707,771 | A | 4/1929 | Richardson | |
| 1,911,215 | A | 5/1933 | Walter | |
| 2,464,951 | A | 3/1949 | Stengren | 206/45.19 |
| 2,595,202 | A | 4/1952 | Pardee | 229/17 |
| 2,643,811 | A | 6/1953 | Bolding | 229/27 |
| 2,799,391 | A | 7/1957 | Eisner | 206/47 |
| 2,913,101 | A | 11/1959 | Daily | 206/45.19 |
| 3,100,595 | A | 8/1963 | Curtiss et al. | 229/27 |
| 3,115,376 | A | 12/1963 | Cupo | 312/35 |
| 3,219,181 | A | 11/1965 | Dahm | 206/45.21 |
| 3,233,726 | A | 2/1966 | Gero | 206/45.31 |
| 3,625,411 | A | 12/1971 | Cote | 229/37 R |
| 3,675,763 | A | 7/1972 | Sandel | 206/45.14 |
| 3,680,687 | A | 8/1972 | D'Alessio | 206/45.14 |
| 3,918,577 | A | 11/1975 | Horzick | 206/45.34 |
| 4,109,786 | A | 8/1978 | Roccaforte et al. | 206/45.14 |
| 4,143,803 | A | 3/1979 | Taylor | 229/27 |
| 4,219,148 | A | 8/1980 | Garmon | 229/28 R |
| 4,324,823 | A | 4/1982 | Ray, III | 428/43 |
| 4,562,922 | A | 1/1986 | Midura | 206/45.19 |
| 4,700,831 | A | 10/1987 | Kassai | 206/232 |
| 4,711,348 | A | 12/1987 | Schluger | 206/45.29 |
| 4,957,202 | A * | 9/1990 | Yoshiki et al. | 206/734 |
| 5,289,917 | A | 3/1994 | Chabria | 206/232 |
| 5,299,734 | A | 4/1994 | Lane | 229/120.32 |

(List continued on next page.)

FOREIGN PATENT DOCUMENTS

| | | | |
|---|---|---|---|
| FR | 2 641 524 | 7/1990 | 81/36 |

*Primary Examiner*—David T. Fidei
(74) *Attorney, Agent, or Firm*—Greenberg Traurig LLP

(57) ABSTRACT

A container apparatus for simultaneously housing a product and a premium, the apparatus comprising a carton and a premium item. The carton includes a front panel, a back panel and two opposing side panels defining an interior region, and a top closure and a bottom closure for enclosing a product within the carton. A recessing flap is formed in an originating panel selected from at least one of the front panel, back panel and two opposing side panels to form a recessed cell in the carton which is at least partially separated from the interior region of the carton. The recessed cell spans the originating panel and at least one adjacent access panel in the container which is positioned adjacent to the originating panel—to allow access to the recessed cell from outside the carton through at least two adjacent sides of the carton. The premium item is received in the recessed cell such that the premium item is likewise accessible from at least two sides of the carton. The premium item may be selected from a number of different configurations, and may include an interactive element capable of manipulation without interfering with the interior region of the carton, to enable facilitated viewing and/or playing of a premium without detachment of the premium from the carton.

16 Claims, 6 Drawing Sheets

U.S. PATENT DOCUMENTS

| | | | | |
|---|---|---|---|---|
| 5,356,071 | A | 10/1994 | Schmissrauter | 229/160 |
| 5,379,886 | A | 1/1995 | Brauner et al. | 206/216 |
| 5,413,274 | A | 5/1995 | Forbes, Jr. | 229/162 |
| 5,433,317 | A | 7/1995 | Roser | 206/232 |
| 5,458,236 | A | 10/1995 | Schoettle et al. | 206/232 |
| 5,566,878 | A | 10/1996 | Peiffer et al. | 229/117.16 |
| 5,692,613 | A | 12/1997 | Opdyke | 206/425 |
| 5,775,494 | A | 7/1998 | Taplin | 206/308.2 |
| 5,887,715 | A | 3/1999 | Vasudeva | 206/373 |
| 5,967,307 | A | 10/1999 | Wang | 206/217 |
| 6,012,786 | A | 1/2000 | Dunn | 312/100 |
| 6,042,149 | A | 3/2000 | Roshkoff | 283/67 |
| 6,070,719 | A | 6/2000 | Pollock | 206/232 |
| 6,095,408 | A | 8/2000 | Nguyen | 229/120.21 |
| 6,155,422 | A | 12/2000 | Kaminski | 206/459.5 |
| 6,173,833 | B1 | 1/2001 | Strechlow | 206/216 |
| 6,474,539 | B1 * | 11/2002 | Van Der Horst | 229/120.14 |

* cited by examiner 22
38
68
42
69
62
64
60
66
52
53
30
54
44
32
28
34
36
56
72
74
70
76
500
57
82
40
84

50
38
22
48
80
24
92
90
46
86
32
30
26
45
98
94
96

30
20
26
38
60
62
32
98
96
24

120
136
145
122
156
158
166
162
150
140
182
124
160
168
164
142

172
170
184
195
192
188
196
178
174
190
202
182

210
252
254
214
250
256
216
212
236
238
246
220
242
244
245
228

CONTAINER FOR HOUSING A PREMIUM

BACKGROUND OF THE INVENTION

1. Field of the Invention

The present invention relates in general to packaging containers and, more particularly, to packaging containers for simultaneously housing a product, such as a food product, and a premium, such as a promotional item.

2. Background Art

Packaging containers for holding or housing a premium or a promotional item have been known in the art for many years. It is often desirable to use a premium or promotional item to entice a purchaser to buy a particular package, or the product contained within that package. Many times, instead of hiding the promotional item inside of the package where a purchaser cannot see what he or she is receiving, a premium or promotional item is attached to or integrated into the outer portion of the container. For instance, many coupons are readily accessible by peeling the coupons from a cover or protected area of a container.

Other prior art devices have utilized containers and cartons having openings or recessed cavities for receiving three dimensional promotional or display items. For instance, Mason, U.S. Pat. No. 1,585,783; Walter, U.S. Pat. No. 1,911,215; Pardee, U.S. Pat. No. 2,595,202; Curtiss et al., U.S. Pat. No. 3,100,595; Dahm, U.S. Pat. No. 3,219,181 and Garmon, U.S. Pat. No. 4,219,148 each disclose containers or cartons having a cut-out in one or more of the front, back or side faces to provide access to the interior of the container. These devices further include a promotional or display item placed proximate the cut-out hole to allow the item to be viewed for display purposes. However, none of these devices include a recessed cell external to the interior of the carton, or a structure for accessing an isolated interior of the carton, other than through the main cut-out hole.

Somewhat similarly, Cote, U.S. Pat. No. 3,625,411; Bolding, U.S. Pat. No. 2,643,811; D'Alessio, U.S. Pat. No. 3,680,687 and Forbes Jr., U.S. Pat. No. 5,413,274 each disclose cartons having a hole in an outer container wall which leads into an isolated internal compartment. In particular, a cut-out is formed in one of the panels of the container blank, which container blank further includes an internal divider or partitioning panel. However, while each carton includes an isolated internal compartment for the potential display and accessibility of a premium or promotional item, none of these references discloses an actual recess in the carton which is formed by a recessing panel integrated directly into one of the front, rear or two side panels of the carton. Moreover, none of the internal compartments are accessible from two different faces of the container.

Also related, Strehlow, U.S. Pat. No. 6,173,833 and Brauner, U.S. Pat. No. 5,379,886, disclose cereal cartons with a hole or cut-out opening in the front panel, and a promotional insert tray which fits into the hole. The tray is covered by a clear membrane, and includes a flange which abuts the outer front surface of the front panel of the carton to keep the tray in the cut-out opening. An additional clear adhesive label is secured over the membrane and tray to prevent tampering with the tray before purchase of the cereal box.

While the Strehlow and Brauner cereal containers have worked well to display a promotional item packaged in a tray to entice a purchaser, neither container makes use of an integral recessing panel to create a recessed cell for housing a premium or promotional item. Furthermore, the premium opening in the Strehlow and Brauner containers spans only one face of the container, thus precluding viewability, removability and access to the premium or promotional item through multiple faces or sides of the package. Neither container is capable of housing a premium or promotional item which requires purchaser interaction and access to the promotional device from more than one face. Moreover, inasmuch as the Strehlow and Brauner premium tray is held inside the cut-out opening in the container by a clear plastic membrane, all access to the promotional device is precluded unless the seal is broken.

Accordingly, it is a goal in the art to provide a container having a recessed cell separated from the interior of the container for housing a premium or promotional item. It is a further goal to allow access to the interior or contents of the container through an opening or location separate from the opening which leads to or houses the recessed cell.

It is also desirable to provide a carton construction which allows for access to the recessed cell from two different sides or faces of the container, to provide access to a premium or promotional item housed within the recessed cell from multiple orientations and/or angles. This is particularly desirable where the premium or promotional item includes an interactive element which exceeds the boundary of the recessed cell when used by a purchaser.

At the same time, it is a goal to provide a recessed cell which retains a premium or promotional item in a secured manner to prevent inadvertent or easy removal thereof.

It is likewise a goal in the art to provide a carton having a recessed cell which has at least one backing panel to add structural integrity to the recessed cell for housing a premium or promotional item, while allowing the container to be formed from a substantially unitary paperboard blank.

These and other desirous characteristics of the present invention will become apparent in light of the present specification (including claims) and drawings.

SUMMARY OF THE INVENTION

The present invention is directed to a container apparatus for simultaneously housing a product and a premium. The container apparatus comprises a carton and a premium item. The carton includes a front panel, a back panel and two opposing side panels defining an interior region, and a top closure and a bottom closure for enclosing a product within the carton. A recessing flap is formed in an originating panel selected from at least one of the front panel, back panel, two opposing side panels and top and bottom closures to form a recessed cell in the carton which is at least partially separated from the interior region of the carton.

In one preferred embodiment, the originating panel is the back panel of the carton. In another preferred embodiment, the originating panel is a side panel of the carton. In still another preferred embodiment, the originating panel is one of the panels which forms the top or bottom closure.

The recessing flap preferably includes a backing panel for the recessed cell and a depth-gauging panel joining the originating panel and the backing panel. The backing panel and depth-gauging panels provide structural integrity to the recessed cell. The depth-gauging panel further determines the depth of the recessed cell.

The recessed cell spans the originating panel and at least one adjacent access panel in the container which is positioned adjacent to the originating panel—to allow access to the recessed cell from outside the carton through at least two adjacent sides of the carton. In one preferred embodiment, the adjacent access panel includes at least one catch region to facilitate retention of the premium item in the recessed cell.

In another preferred embodiment, the originating panel and/or the adjacent access panel includes at least one push-in flap to further isolate the recessed cell from the interior region of the carton. Likewise, the push-in flaps may further provide added structural strength to the recessed cell.

The premium item is preferably received in the recessed cell such that the premium item is accessible from at least two sides of the carton. The premium item may be selected from a number of different configurations, and may include an interactive element capable of manipulation without interfering with the interior region of the carton, to enable facilitated viewing and/or playing of a premium without detachment of the premium from the carton. In one preferred embodiment, the premium item includes a viewing portion and a boundary exceeding member, wherein the boundary exceeding member is capable of manipulation for movement between a position substantially inside the recessed cell to a position substantially outside of the recessed cell.

In a preferred embodiment, the premium item includes a tray for housing a promotional item. The tray may include a cover which is at least partially transparent so that the promotional item is visible inside the tray. The tray may also include a flange for abutting at least a portion of the originating panel and/or the adjacent access panel to facilitate retention of the tray in the recessed cell. The tray may further include a removable side flap to provide an additional premium bearing opportunity.

Further, a packaging card may be included for housing the premium item in the recessed cell. The packaging card may be retained in the recessed cell by a friction fit, or with an adhesive. The packaging card may be adhered to at least one of the originating panel, the recessing panel and/or the adjacent access panel.

DETAILED DESCRIPTION OF THE DRAWINGS

Figure 1:
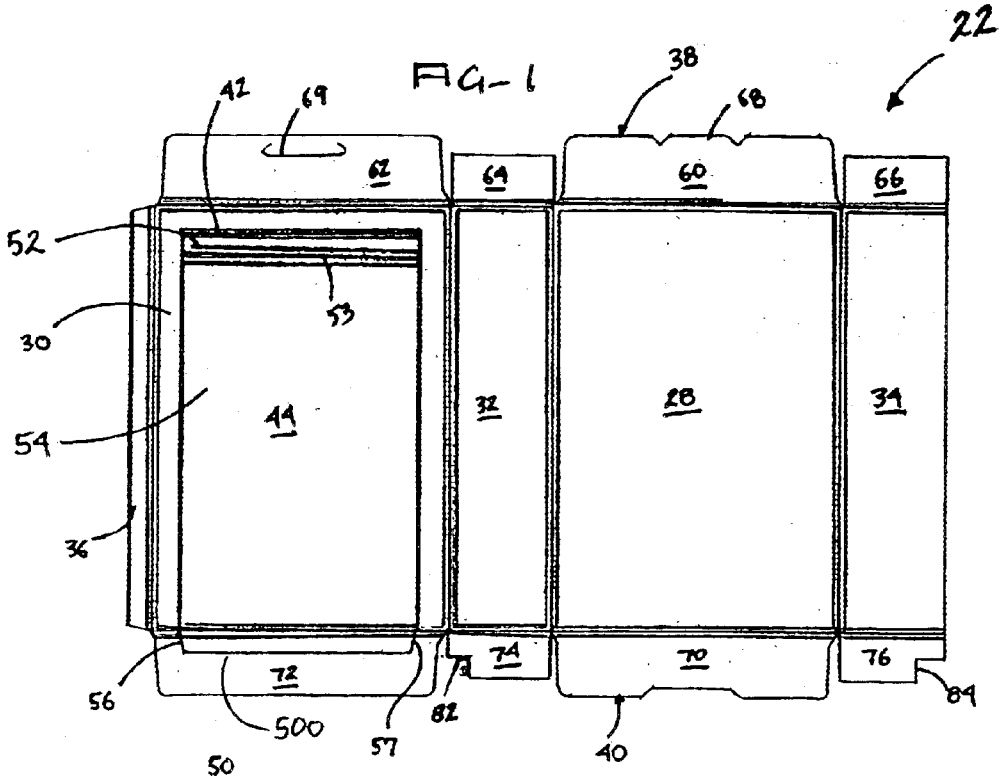
FIG. 1 is a plan view of a blank for forming a carton having a recessed cell for housing a premium item.

While this invention is susceptible of embodiment in many different forms, there are shown in the drawings and will herein be described in detail several specific embodiments with the understanding that the present disclosure is to be considered as an exemplification of the principals of the invention and is not intended to limit the invention to the embodiments illustrated.

Container 20 for simultaneously housing a product and a premium is shown in FIGS. 1-4 as comprising carton 22, packaging card 24 and premium item 26. Carton 22 is formed from a unitary paperboard blank shown in FIG. 1, and includes front panel 28, back panel 30, side panels 32 and 34, sealing tab 36, top closure 38 and bottom closure 40. As can be seen from FIG. 1, each of front panel 28, back panel 30, side panels 32 and 34 and sealing tab 36 are hingedly connected at fold lines for articulation into a substantially rectangular container, shown in FIGS. 2-4. Further, while carton 22 is shown as taking the form of a standard cereal box, the dimensions of the various carton panels may be changed or altered to create an alternative container configuration, as would be known by those with ordinary skill in the art with the present disclosure before them.

Figure 4:
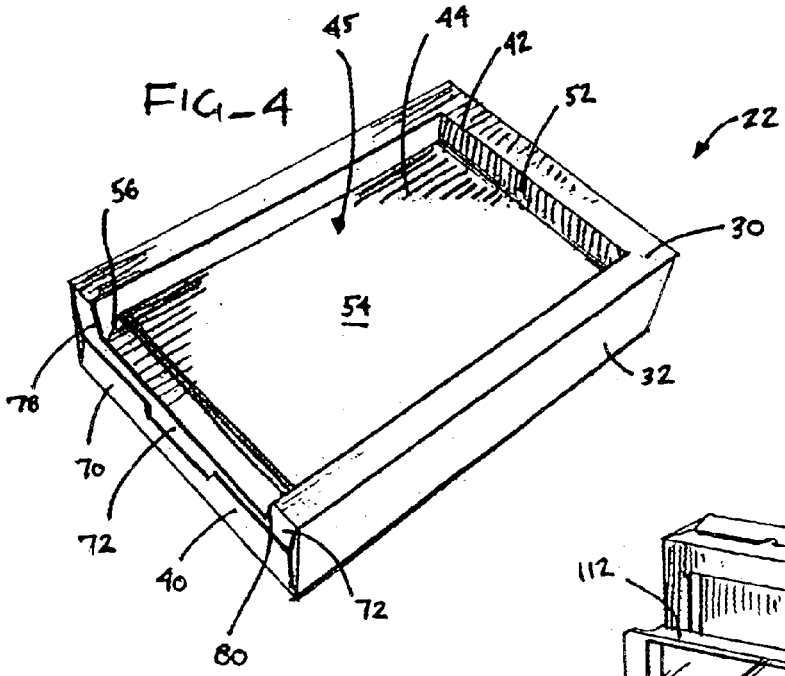
FIG. 4 is a perspective view of the carton shown in FIG. 1 as articulated.

Back panel 30, shown in FIGS. 1 and 4, includes interior fold line 42, recessing flap 44, side strips 46 and 48 and top strip 50. Interior fold line 42, shown in FIGS. 1 and 4, comprises a substantially horizontal fold line which is preferably entirely contained within the boundaries of back panel 30. Thus, while recessing flap 44 is eventually folded out of the plane of back panel 30, side strips 46 and 48 and top strip 50 remain at the original, elevated level. Upon articulation, recessing flap 44 is folded inwardly into the interior of carton 22 along interior fold line 42, to create recessed cell 45. To this end, interior fold line 42 may extend differing lengths across back panel 30, to increase or decrease the corresponding width of recessing flap 44, and thus recessed cell 45. Additionally, while interior fold line 42 is shown as positioned in the top of back panel 30, interior fold line 42 may also be positioned at lower points in back panel 30 to reduce the height of recessed cell 45, to accommodate desired recessed cell dimensions or the dimensions of a particular premium item.

It should be noted that in the particular carton embodiment shown in FIGS. 1-4, back panel 30 serves as the originating panel—the panel from which recessing flap 44 foldably emanates. As will become evident throughout the description in this specification, as well as in the drawings, it is contemplated that the originating panel may vary, thus changing the dimensions and/or orientation of the recessing flap and recessing cell, depending on the orientation and dimensions of the interior fold line.

Figure 2:
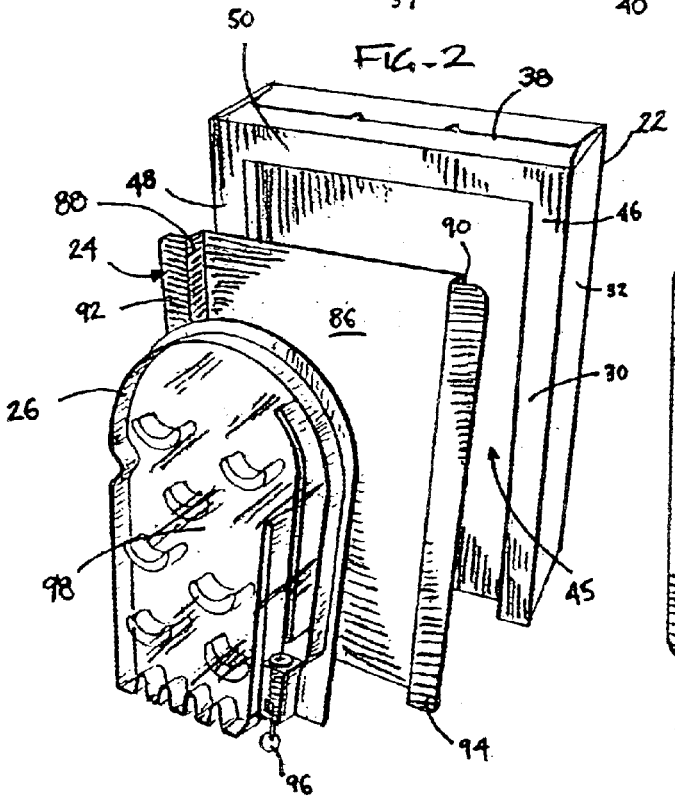
FIG. 2 is an exploded perspective view of the carton shown in FIG. 1 as articulated, with a packaging card and premium item for insertion into the recessed cell formed in the carton.

Recessing flap 44, shown in FIGS. 1, 2 and 4, includes depth-gauging panel 52 and backing panel 54. Depth-gauging panel 52 is hingedly joined to backing panel 54 at fold line 53, and joined to back panel 30 at interior fold line 42. Depth-gauging panel 52 preferably folds downwardly into the interior region of carton 22, to provide recessed cell 45 with a specified depth. In particular, depth-gauging panel 52 is preferably folded to an orientation which is substantially orthogonal to both back panel 30, as well as backing panel 54—thus forming one closed side of recessed cell 45. Further, the height of depth-gauging panel 52 dictates the depth of recessed cell 45, which depth may be varied by varying the height of depth-gauging panel 52 to suit any particular premium item or application.

Figure 3:
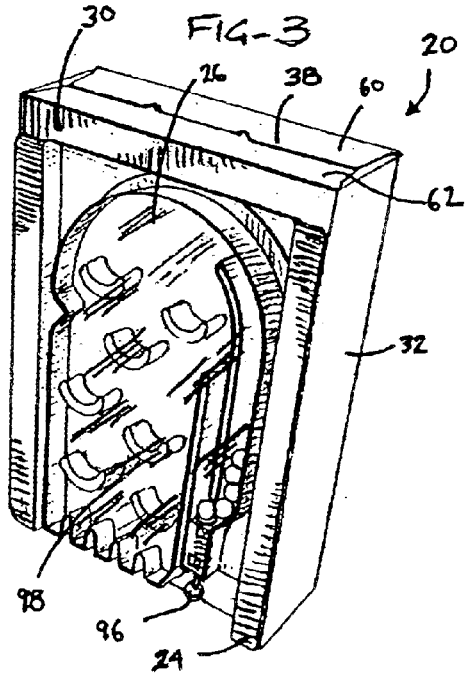
FIG. 3 is a perspective view of the container apparatus shown in FIG. 2 as assembled for simultaneously housing a product and a premium item.

As can be seen from FIG. 1, backing panel 54 extends from the originating back panel 30 into back panel bottom flap 72, and includes angled bottom edges 56 and 57. The extra extension of backing panel 54 into back panel bottom flap 72 ensures that upon articulation of carton 22, backing panel 54 extends from its foldable connection to depth-gauging panel 52 all the way to the bottom of carton 22, as shown in FIGS. 2-4. Thus, backing panel 54 separates and at least partially isolates recessed cell 45 from the interior of carton 22. This separation is particularly advantageous in the present context, as carton 22 is preferably designed to hold a product, such as cereal, in its interior region, which product is preferably separated from a premium item 26 housed within recessed cell 45. While recessed cell 45 is not necessarily entirely isolated from the interior of carton 22, allowing for openings on the sides of recessed cell 45, recessing flap 44 provides a substantial barrier between the interior of carton 22 and recessed cell 45. Certainly, a carton construction in which the recessed cell is more completely or entirely isolated from the interior of the carton is likewise contemplated, as would be known by those with ordinary skill in the art with the present disclosure before them. Further, recessing flap 44 provides structural integrity to recessed cell 45 for housing a premium item therein.

Backing panel 54 also preferably includes angled bottom edges 56 and 57, shown in FIGS. 1 and 4. As will be discussed in more detail below, while angling portions of the bottom edges of backing panel 54 removes very little of backing panel, the angling creates catch regions 78 and 80 in back panel bottom flap 72, shown in FIG. 4, to help maintain premium item 26 in recessed cell 45.

Top closure 38, shown in FIG. 1, includes front panel top flap 60, back panel top flap 62 and side panel top flaps 64 and 66. As is conventional with many reclosable containers, front panel top flap 60 includes closure tab 68, while back panel top flap 62 includes tab insert cut-out 69. Thus, top closure 38 allows the interior of carton 22 to be accessed without disturbing or altering premium item 26 in recessed cell 45.

Bottom closure 40, shown in FIGS. 1 and 4, includes front panel bottom flap 70, back panel bottom flap 72 and side panel bottom flaps 74 and 76. While top closure 38 is somewhat conventional for recloseable containers which house cereal and other similar types of products, bottom closure 40 is modified to accommodate recessing flap 44, as well as to facilitate access to recessed cell 45 through the adjacent bottom side of carton 22. In particular, each of side panel bottom flaps 74 and 76 includes a notch 82 and 84, respectively, to ensure that the side panel bottom flaps do not interfere with or obstruct access to recessed cell 45 through bottom closure 40. Moreover, as touched upon above, back panel bottom flap 72 includes catch regions 78 and 80 to help retain premium item 26 in recessed cell 45. More specifically, catch regions 78 and 80 are the angled portions of back panel bottom flap 72 formed by the cut-out of recessing flap 44 from back panel bottom flap 72. Catch regions 78 and 80 help hold the bottom portion of premium item 26 and/or packaging card 24 in recessed cell 45.

However, the catch regions may also allow a premium item to be housed within recessed cell without a packaging card, without any type of flange extending from the premium item for abutting back panel 30, or without actually attaching or adhering the premium item to any portion of carton 22. For instance, the premium item may take the form of a simple rectangular tray or box-like structure, which substantially matches the dimensions of recessed cell 45 and fits therein by an interference or friction fit. Alternatively, it is also contemplated that recessing flap 44 may include straight, non-angled bottom edges, to eliminate the catch regions, thus allowing a premium item to slide into and out of recessed cell 45 from both the back panel 30 side of carton 22, as well as from the bottom closure 40 side of carton 22.

Thus, upon articulation, carton 22 allows for access to recessed cell 45 through originating back panel 30, but also access through an adjacent access panel, namely bottom closure 40, and more particularly through back panel bottom flap 72. Access to recessed cell 45 from two adjacent sides of carton 22 permits use of carton 22 with a multiplicity of premium items, including premium item 26 including an interactive element described below.

Packaging card 24 is shown in FIGS. 2-4 as comprising central backing panel 86, depth adding panels 88 and 90 and wing panels 92 and 94. Depth adding panels 88 and 90 determine depth of packaging card 24 and thus the thickness of a particular promotional item which may be housed within packaging card 24—if the promotional item is to be housed completely within or flush with the tray region of packaging card 24. Further, it is also preferred that depth adding panels 88 and 90 are approximately the same height as depth-gauging panel 52 of recessing flap 44 to utilize the entire depth of recessed cell 45. Central backing panel 86 of packaging card 24 may be attached or adhered to backing panel 54 of recessing flap 44, if such a secured relationship between packaging card 24 and recessing flap 44 is desired.

Wing panels 92 and 94, shown in FIGS. 2 and 3, are preferably sized to abut side strips 46 and 48 of back panel 30 when packaging card 24 is positioned into recessed cell 45. To this end, wing panels 92 and 94 are preferably of a dimension matching the width of side strips 46 and 48, or of a lesser width to ensure that wing panels 92 and 94 do not extend beyond the boundaries of back panel 30. Further, it should likewise be noted that packaging card 24 may be retained in recessed cell 45 by a friction or interference fit, or by an adhesive placed between either wing panels 92 and 94 and side strips 46 and 48 and/or between central backing panel 86 of packaging card 24 and backing panel 54 of recessing flap 44. Of course, catch regions 78 and 80 on bottom closure 40 further act to retain packaging card 24 in recessed cell 45.

Premium item 26, one example of which is shown in FIGS. 2 and 3, is preferably an interactive promotional device requiring and/or allowing a purchaser to use the promotional item either in recessed cell 45 of carton 22, or after removing premium item 26 from carton 22. In particular, premium item 26 is shown as comprising a pinball game, including both a boundary exceeding member 96 and viewing portion 98. Boundary exceeding member 96 comprises the spring loaded plunger which places the pinballs into play, while viewing portion 98 comprises the portion of the game that allows a user to view the path and ultimate location of pinballs. Viewing portion 98 is preferably protected by a transparent cover, such that premium item 26 may be housed within blister card 24 in recessed cell 45 without any additional cover on the back of carton 22. Alternatively, a preferably transparent cover may be placed over premium item 26 as housed within recessed cell 45, as long as the interactive element/boundary exceeding member 96 is still accessible. In the particular embodiment shown in FIGS. 1-4, this may be accomplished by placing a clear, transparent cover over the back face of carton 22, but leaving an opening in bottom closure 40 such that a user can access boundary exceeding member 96. This may also be accomplished by covering the entirety of premium item 26, while still providing a tear-away or break-away portion to permit easy access to the interactive element/boundary exceeding member.

In any event, premium item 26 may be accessed from two different, but adjacent sides of carton 22, namely the back side of the carton as well as the bottom side of the carton. Thus, a user may pull boundary exceeding member 96 downwardly through the opening in bottom closure 40 to place the pinballs into play, thus positioning the plunger outside of recessed cell 45 below the boundaries of carton 22. At the same time, the user may view the path and location of those pinballs through the back side of carton 22.

It must be also noted that premium item may be housed within recessed cell 45 without packaging card 24, either by a friction or interference fit, or attached inside recessed cell 45, such as by an adhesive. Likewise, as will be seen below with the illustrations and description of a number of alternative premium items, premium item 26 shown in FIGS. 2 and 3 is simply an example of one of many premium items contemplated for use with the present invention. Any number of premium items, including both those which include an interactive element and those which do not, are contemplated for use with carton 22 as would be known by those with ordinary skill in the art with the present disclosure before them.

Figure 5:
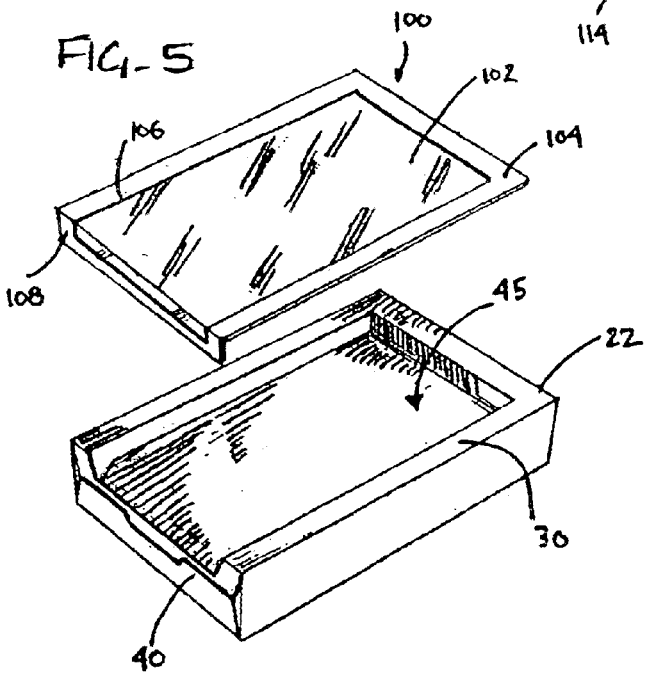
FIG. 5 is an exploded perspective view of a container apparatus for simultaneously housing a product and a premium according to another embodiment of the present invention, with a premium cover for shielding a premium item.

For instance, in an alternative embodiment shown in FIG. 5, carton 22 may be used in combination with promotional cover 100. Promotional cover 100 includes window 102, frame 104, first portion 106 and second portion 108. Frame 104 is preferably of a width to substantially match the surrounding raised portion of back panel 30, while window 102 preferably substantially matches the dimensions of recessed cell 45 on first portion 106 and second portion 108. As can be seen from FIG. 5, first portion 106 is preferably foldably joined to second portion 108, such that first portion 106 covers access to recessed cell 45 through back panel 30, while second portion 108 covers access to recessed cell 45 through bottom closure 40. Thus, window 102 preferably allows viewability of a promotional item housed within recessed cell 45 through both the adjacent back and the bottom portions of carton 22. Promotional cover 100 may be permanently sealed to carton 22, or temporarily sealed to carton 22 to allow removal of promotional cover 100 for access to a promotional item contained within recessed cell 45.

Figure 6:
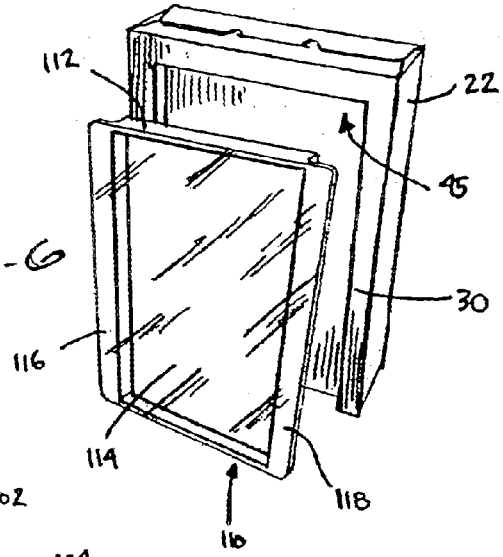
FIG. 6 is an exploded perspective view of a container apparatus for simultaneously housing a product and a premium according to another embodiment of the present invention, with a premium t ray.

In another alternative embodiment, shown in FIG. 6, carton 22 is used in combination with promotional container 110. Promotional container 110 includes tray portion 112, clear window cover 114 and side flanges 116 and 118. Promotional container 110 is designed to house a promotional item inside, while permitting viewing of that promotional item through clear window cover 114. Flanges 116 and 118 are provided to enhance the retention of promotional tray 110 in recessed cell 45, by abutting the side portions of back panel 30. Of course, the configuration of promotional container 110 may be altered, depending upon the application and the promotional item to be housed therein. Flanges 116 and 118 also prevent promotional container 110 from sliding into the openings on either side of recessed cell which lead into the interior of carton 22. However, promotional container may be constructed without flanges, and still be housed in recessed cell 45, particularly if adhesive is employed and/or if bottom closure 40 includes catch region 78 and 80, shown in FIG. 4.

Figure 7:
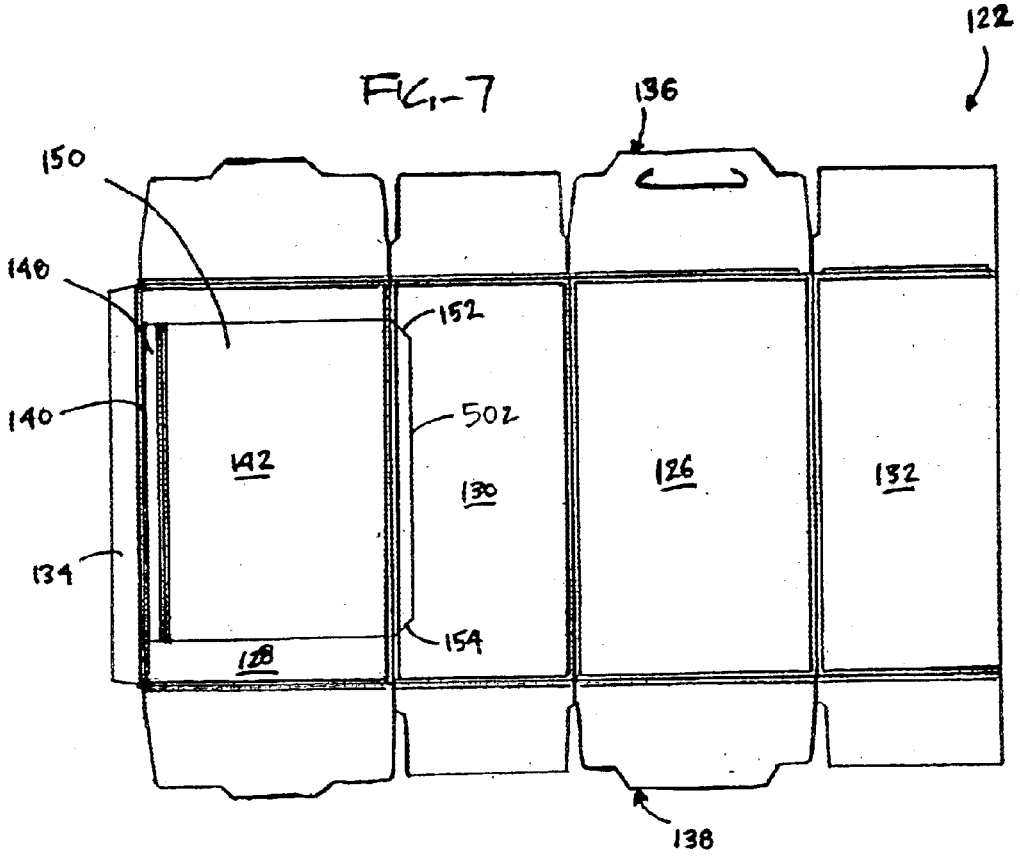
FIG. 7 is a plan view of a blank for forming a carton having a recessed cell according to another embodiment of the present invention.
Figure 8:
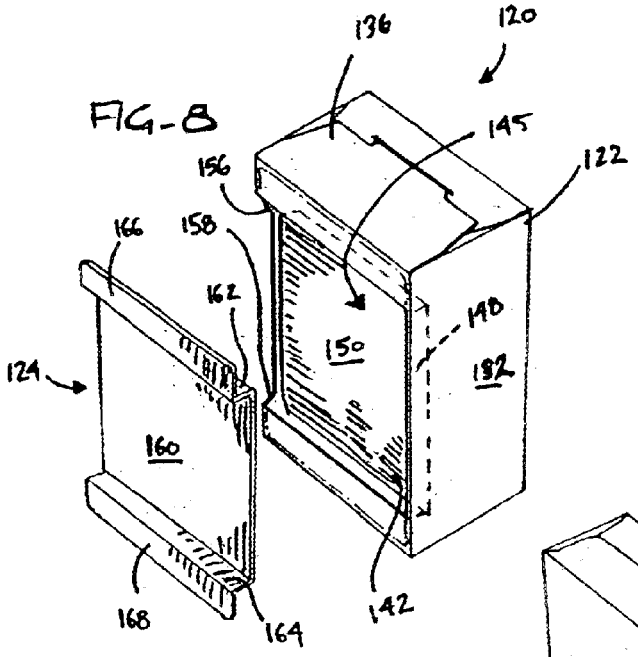
FIG. 8 is an exploded perspective view of the carton shown in FIG. 7 as articulated, with a packaging card for housing a premium item.

In another alternative embodiment, shown in FIGS. 7 and 8, container 120 for simultaneously housing a product and a premium includes carton 122 and packaging card 124. Like carton 22, carton 122 includes front panel 126, back panel 128, side panels 130 and 132, sealing tab 134, top closure 136 and bottom closure 138. However, unlike the back panel of carton 22, back panel 128 of carton 122 includes interior fold line 140 orientated vertically between the top and bottom edges of back panel 128. Thus, recessing flap 142 foldably emanates from back panel 128 along interior fold line 140 to position recessing flap 142 in a substantially horizontal orientation, as opposed to the substantially vertical orientation of recessing flap 44 in carton 22. Further, as touched on above with carton 22, interior fold line 140 may be positioned further inside back panel 128, to reduce the width of recessed cell 145. Likewise, the height of interior fold line 140 may be reduced to, in turn, reduce the height of recessing flap 142 and the height of recessed cell 145.

As is shown in FIGS. 7 and 8, recessing flap 142 includes depth-gauging panel 148 and backing panel 150. Like recessing flap 44 of carton 22, depth-gauging panel 148 dictates the depth of recessed cell 145. Further, backing panel 150 also includes angled bottom edges 152 and 154, which generate catch regions 156 and 158 in side panel 130. Thus, recessed cell 145 is accessible from both back panel 128 (the originating panel) of carton 122, as well as from side panel 130 (the adjacent access panel) of carton 122. This allows viewability of a premium item from adjacent sides of carton 122, as well as access to an interactive promotional item contained in recessed cell 145 through both the back and side panel access openings.

Packaging card 124 is similar to packaging card 24, and includes central backing panel 160, depth adding panels 162 and 164, and wing panels 166 and 168. However, packaging card 124 is oriented substantially horizontally, rotated 90° from packaging card 24, to match recessed cell 145 of carton 122. Further, while not shown, it is certainly contemplated that the packaging card may house a promotional item, or that a promotional item is housed in recessed cell 145 without a packaging card.

Figure 9:
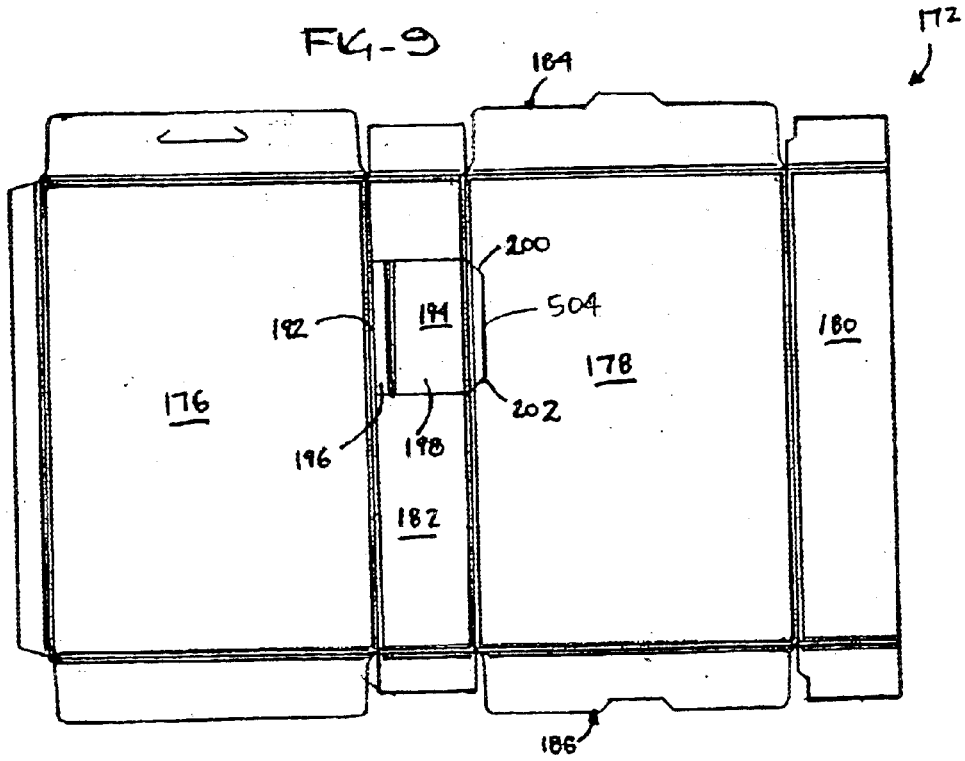
FIG. 9 is a plan view of a blank for a forming carton having a recessed cell according to another embodiment of the present invention.
Figure 10:
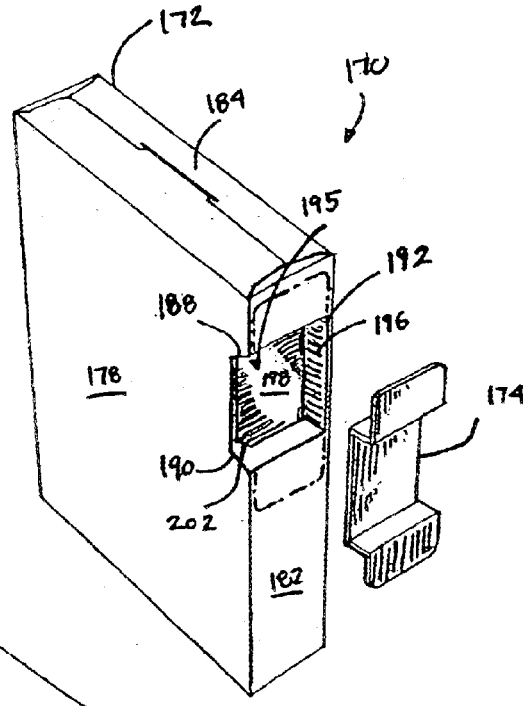
FIG. 10 is an exploded perspective view of the carton shown in FIG. 9 as articulated, with a packaging card for housing a premium item.

In another embodiment shown in FIGS. 9 and 10, container 170 includes carton 172 and packaging card 174. Carton 172 includes front panel 176, back panel 178, first side panel 180, second side panel 182, top closure 184 and bottom closure 186. While carton 172 is substantially the same shape and dimension as carton 22, recessing flap 194 is located in second side panel 182, foldably emanating from interior fold line 192. Like interior fold line 140 in carton 122 shown in FIGS. 7 and 8, interior fold line 192 is orientated vertically, such that recessing flap 194 takes a substantially horizontal orientation. Again, the location and size of interior fold line 192 may be altered to change the size and dimensions of recessing flap 194 and thus recessed cell 195.

Recessing flap 194 is shown in FIGS. 9 and 10 as including depth-gauging panel 196 and backing panel 198. Like the depth-gauging panels on cartons 22 and 122, depth-gauging panel 196 determines the depth of recessed cell 195 for housing a promotional item having a specified shape and thickness. Backing panel 198 further includes angled bottom edges 200 and 202, thus providing catch regions 188 and 190 in back panel 178, which facilitate retention of promotional item in recessed cell 195.

In the embodiments shown in FIGS. 9 and 10, the originating panel comprises side panel 182 of carton 172, while the adjacent access panel comprises back panel 178. Like cartons 22 and 122, the recessed cell of carton 172 may be viewed and accessed from two adjacent sides of the carton.

Packaging card 174 is shown in FIG. 10 as having substantially the same structure as packaging cards 24 and 124 shown in FIGS. 2 and 8, respectively. As such, packaging card 174 is designed to house a promotional item, and to be secured in recessed cell 195. As can be seen from FIG. 10, the wings of packaging card 174 preferably abut the top and bottom portions of second side panel 182, above and below recessed cell 195.

Figure 12:
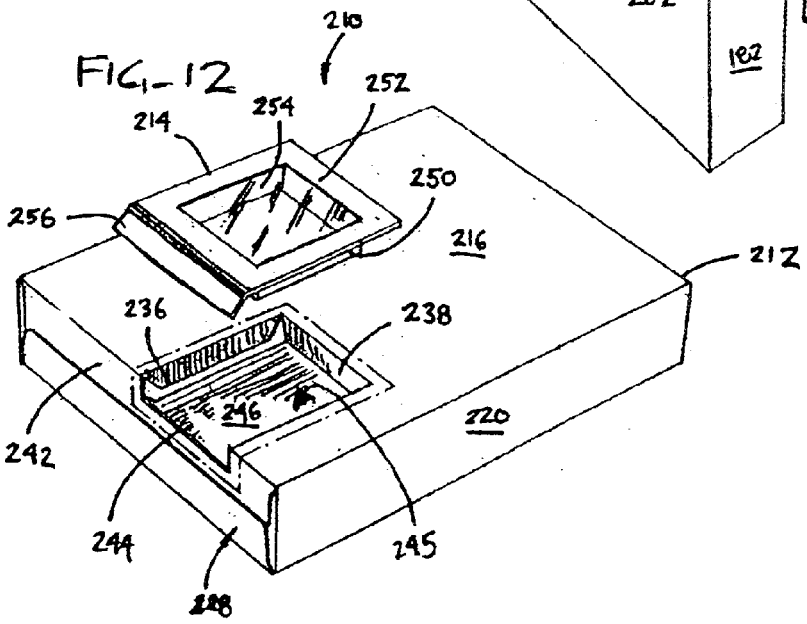
FIG. 12 is an exploded perspective view of the carton shown in FIG. 11 as articulated, with a premium tray for insertion into the recessed cell.
Figure 11:
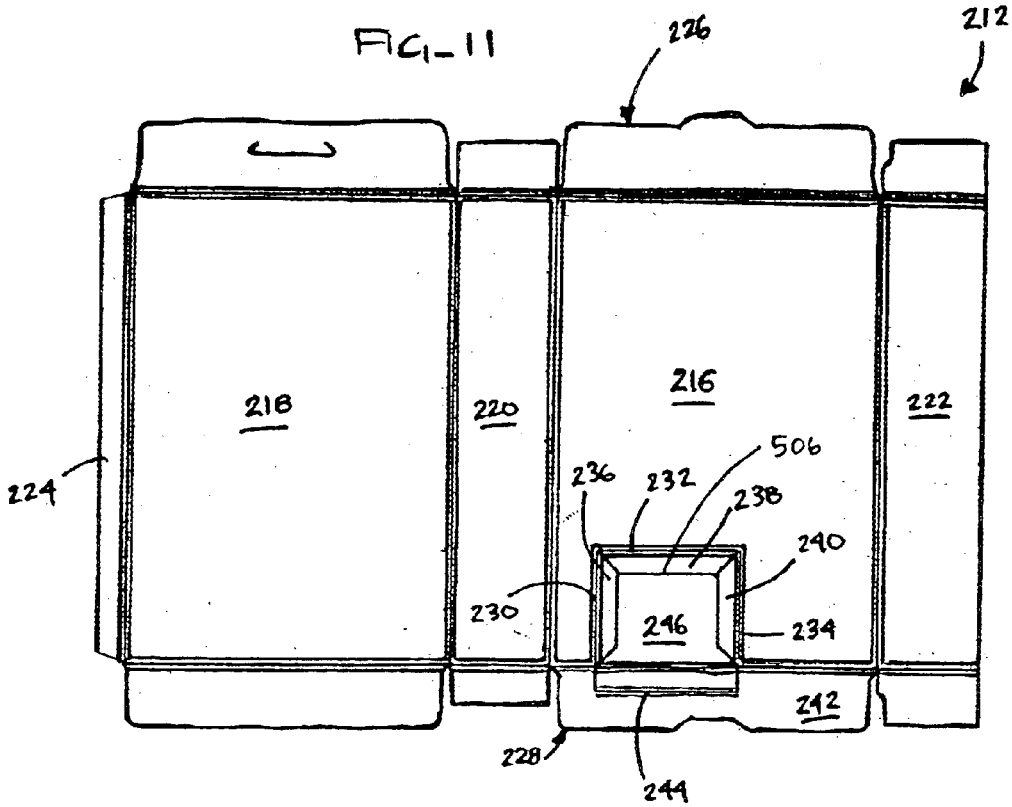
FIG. 11 is a plan view of a blank for forming a carton having a recessed cell according to another embodiment of the present invention.

In another embodiment, shown in FIGS. 11 and 12, container 210 includes carton 212 and promotional container 214. Carton 212 includes front panel 216, back panel 218, side panels 220 and 222, sealing tab 224, top closure 226 and bottom closure 228. Front panel 216 includes interior fold lines 230, 232 and 234, and push-in flaps 236, 238 and 240. As is shown in FIG. 12, push-in flaps 236, 238 and 240 are preferably pushed in such that they are substantially orthogonal to front panel 216. The push-in flaps help separate recessed cell 245 from the interior of carton 212, and add to the structural integrity of recessed cell 245. Further, push-in flaps 236, 238 and 240 may also serve to abut against promotional container 214 once it is positioned into cell 245, to further enhance retention of promotional container 214 inside of recessed cell 245.

Bottom closure 228 includes front panel bottom flap 242, which, in turn, includes interior fold line 244 and recessing panel 246. Recessing panel 246 is folded from front panel bottom flap 242 along interior fold line 244 to a position substantially orthogonal to bottom closure 228, such that it forms a backing for recessed cell 245. As such, recessing panel 246 helps separate and isolate recessed cell 245 from the interior of carton 212, which typically houses a product sold in carton 212.

Moreover, recessed cell 245 is accessible from both the originating panel of recessing panel 246, namely front panel bottom flap 242, as well as from an adjacent access panel, namely front panel 216. As such, recessed cell 245 can be accessed from adjacent sides of carton 212. Accordingly a premium item housed within recessed cell 245 may be viewed and accessed from two different sides of the premium, such as promotional container 214. Of course, while promotional container 214 is shown in FIG. 12 for use with carton 212, it is likewise contemplated that any number of premium or promotional items may be used in combination with carton 212, including premium or promotional items having an interactive element.

Promotional container 214 includes tray portion 250, annular flange 252, clear window 254 and side flap 256. Tray portion 250 is structured to house a promotional item, while annular flange 252 is designed to abut front panel 216 of carton 212 to help maintain promotional container 214 in recessed cell 245. Clear window 254 allows a purchaser to view the promotional item before purchasing container 210. Side flap 256 acts to block off any opening through bottom closure 228 to the interior of carton 212, and as a separate premium opportunity. For instance, side flap 256 may tear off from annular flange 252, and contain a coupon or other collectible item for use by a purchaser. Promotional container 214 may be housed in recessed cell 245 by a friction or interference fit, by an adhesive or by other means known to those of ordinary skill in the art with the present disclosure before them.

Figure 13:
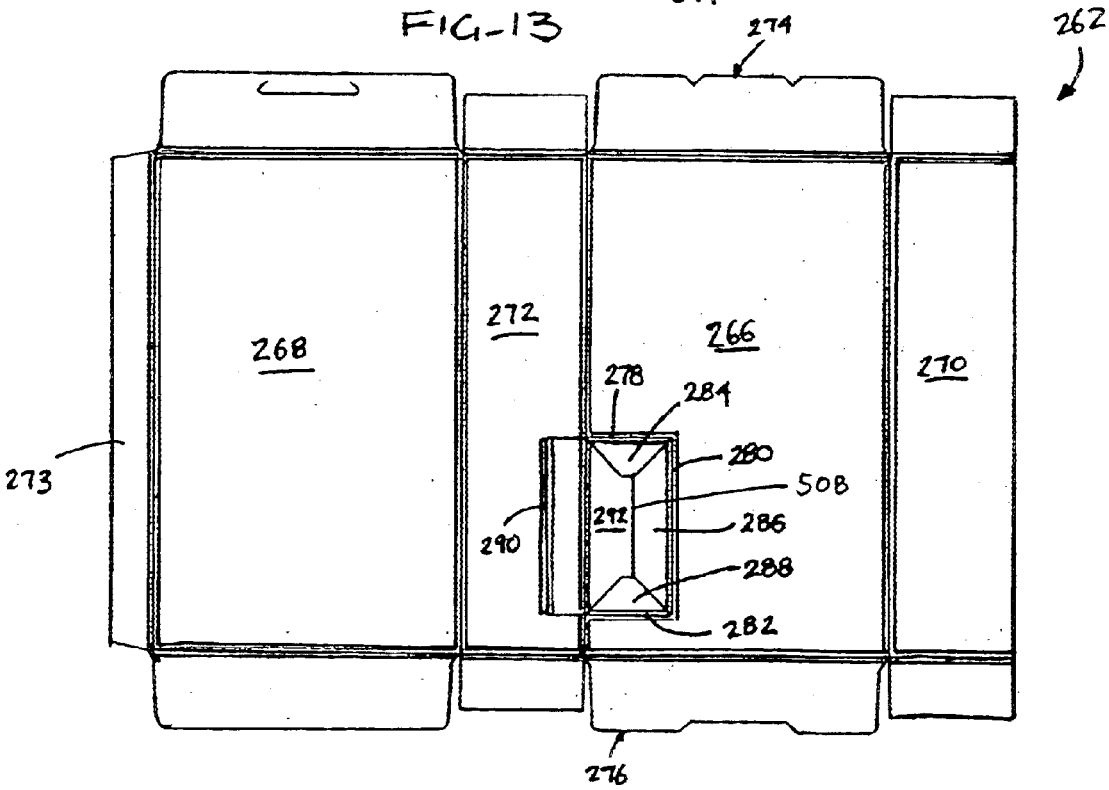
FIG. 13 is a plan view of a blank for forming a carton having a recessed cell according to another embodiment of the present invention.
Figure 14:
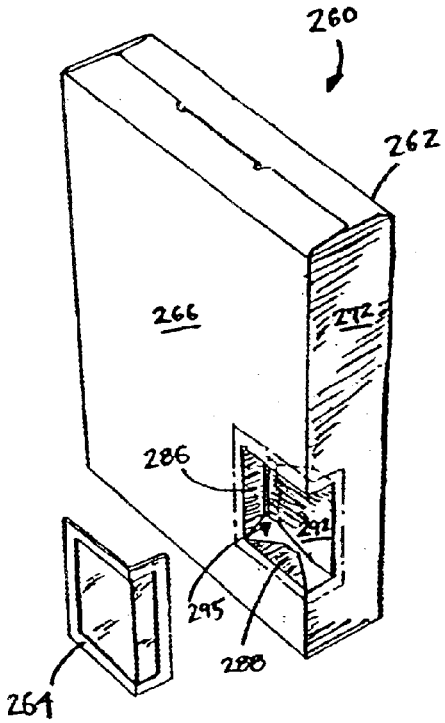
FIG. 14 is an exploded perspective view of the carton shown in FIG. 13 as articulated, with a premium cover to facilitate housing a premium item in the recessed cell.

In another embodiment, shown in FIGS. 13 and 14, similar to that shown in FIGS. 11 and 12, container 260 is shown as comprising carton 262 and promotional cover 264. Carton includes front panel 266, back panel 268, first side panel 270, second side panel 272, sealing tab 273, top closure 274 and bottom closure 276. Front panel 266 includes interior fold lines 278, 280 and 282 and push-in flaps 284, 286 and 288. As can be seen from FIG. 13, each of the push-in flaps originate from respective interior fold lines 278, 280 and 282 in front panel 266. Like the push-in flaps described with respect to FIGS. 11 and 12, push-in flaps 284, 286 and 288 are preferably pushed into the interior carton 262 such that they are oriented substantially orthogonally to front panel 266 to provide a barrier between the interior of carton 262 and recessed cell 295.

Second side panel 272 includes recessing flap 292 foldably emanating from second side panel 272 at vertically oriented interior fold line 290. Like recessing flap 246, recessing flap 292 forms a backing panel for recessed cell 295. However, while recessed cell 245 has access openings in the adjacent front and bottom portions of carton 212, recessed cell 295 includes access openings in front panel 266 and second side panel 272 of carton 262. Thus, a premium or promotional item is viewable and/or accessible from both the side of carton 262, as well as from the front of carton 262.

Promotional cover 264 preferably fits over recessed cell 295 to completely cover same for housing of a premium or promotional item inside recessed cell 295. Promotional cover 264 preferably includes a window which spans both the front panel (266) side of carton 262, as well as the adjacent side (272) of carton 262, to facilitate viewing of a promotional item from two separate sides of carton 262. However, it is likewise contemplated that promotional cover may be replaced with other suitable promotional or premium items, such as those shown and disclosed in the present application, as well as those that would be known by those with ordinary skill in the art with the present disclosure before them.

Figure 16:
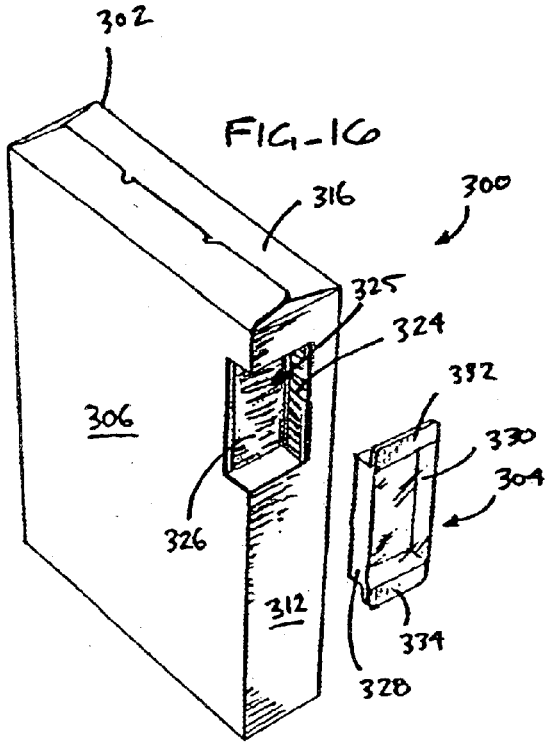
FIG. 16 is an exploded perspective view of the carton shown in FIG. 15 as articulated, with a premium tray for insertion into the recessed cell.
Figure 15:
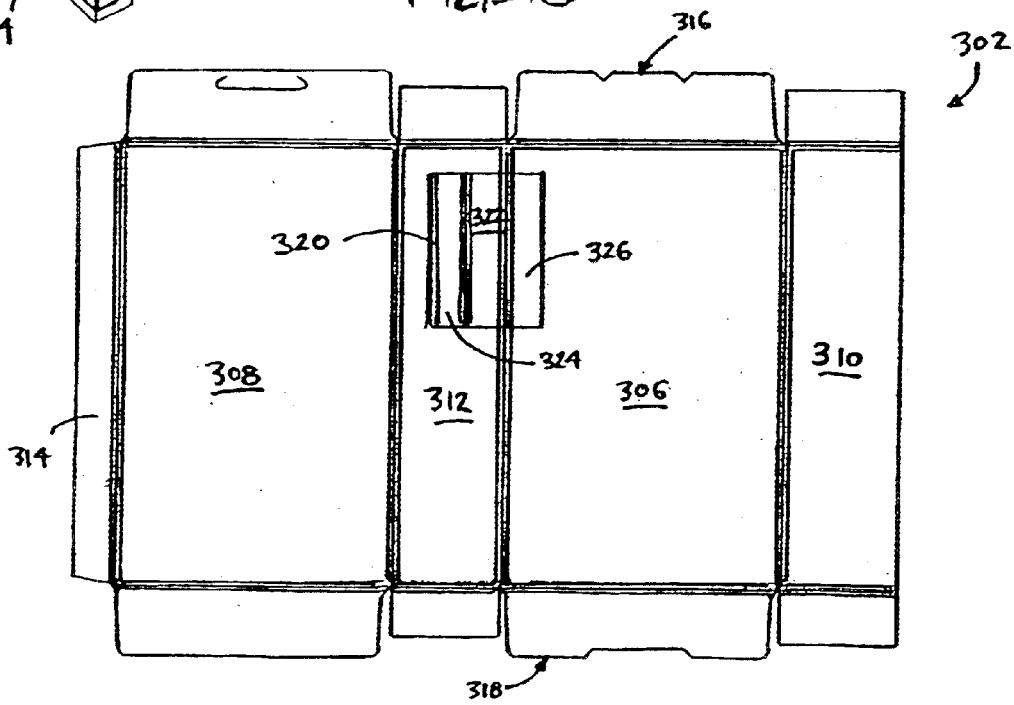
FIG. 15 is a plan view of a blank for a carton having a recessed cell according to another embodiment of the present invention.

In another alternative embodiment, shown in FIGS. 15 and 16, container 300 includes carton 302 and promotional container 304. Carton 302 includes front panel 306, back panel 308, first side panel 310, second side panel 312, sealing tab 314, top closure 316 and bottom closure 318. Second side panel 312 includes vertically oriented interior fold line 320, and recessing flap 322 foldably emanating therefrom. Thus, recessing flap 322 takes a substantially horizontal orientation, dictating the size and orientation of recessed cell 325. Moreover, while recessing flap 322 originates in second side panel 312, the recessing flap continues into an adjacent access panel, in this embodiment shown as front panel 306. Recessing flap 322 further includes depth-gauging panel 324 and backing panel 326. Like the depth-gauging panels and backing panels described above, depth-gauging panel 324 determines the depth of recessed cell 325, while backing panel 326 provides separation between recessed cell 325 and the interior of carton 302, amongst other functions. Recessed cell 325 may be viewed and accessed from two adjacent sides of carton 302, namely from front panel 306 as well as from second side panel 312.

Promotional container 304 is shown in FIG. 16 as including tray portion 328, clear window 330 and top and bottom flanges 332 and 334, respectively. Promotional container 304 is designed to house a promotional item, which may be viewed through clear window 330. Top and bottom flanges 332 and 334 preferably abut the regions of second side panel 312 above and below recessed cell 325 to help maintain promotional container 304 in recessed cell 325. As described above, promotional container 304 may be housed within recessed cell 325 by an interference fit and/or a separate adhesive. Furthermore, inasmuch as carton 302 is not shown as including a catch region, promotional container 304 may be slid in and out of recessed cell either through second side panel 312 or through front panel 306, thus allowing removal and insertion of promotional container 304 into recessed cell 325 through different paths. Of course, any number of promotional containers or premium items may be used in combination with carton 302.

The foregoing description and drawings merely explain and illustrate the invention, and the invention is not limited thereto except insofar as the appended claims are so limited as those skilled in the art having the present disclosure before them will be able to make modifications and variations therein without departing from the scope of the invention.

What is claimed is:

1. A container apparatus for simultaneously housing a product and a premium, said container apparatus comprising:

a carton including a front panel, a back panel and two opposing side panels defining an interior region, each of the front panel, back panel and two opposing side panels having top and bottom edges;

a top closure and a bottom closure for enclosing a product within the carton;

at least one recessing flap formed in at least one of the front panel, back panel, two opposing side panels and top and bottom closures, said at least one recessing flap having a top edge, a bottom edge and two side edges, said at least one recessing flap foldably emanating from an originating panel selected from at least one of the front panel, back panel, two opposing side panels, top closure and bottom closure along one of the top, bottom and two side edges of the recessing flap to form a recessed cell in the carton which is at least partially separated from the interior region of the carton, at least one access panel adjacent to said originating panel comprising at least one of said front panel, back panel, two opposing side panels, top closure and bottom closure;

the recessed cell spanning at least a portion of the originating panel and at least a portion of the at least one adjacent access panel to allow access to the recessed cell from outside the carton through at least two adjacent sides of the carton;

a premium item for receipt within the recessed cell, the premium item likewise being accessible from at least two sides of the carton; and a packaging card for housing the premium item in the recessed cell.

2. The container apparatus according to claim 1 wherein the packaging card includes at least one flange for butting at least a portion of at least one of the originating panel and the adjacent access panel for retaining the blister card in the recessed cell.

3. The container apparatus according to claim 1 wherein the packaging card is retained in the recessed cell by a friction fit.

4. The container apparatus according to claim 1 wherein the packaging card is adhered by an adhesive to at least one of the recessing panel, the originating panel and the adjacent access panel.

5. A container apparatus for simultaneously housing a product and a premium, said container apparatus comprising:

a carton including a front panel, a back panel and two opposing side panels defining an interior region, each of the front panel, back panel and two opposing side panels having top and bottom edges;

a top closure and a bottom closure for enclosing a product within the carton;

at least one recessing flap formed in at least one of the front panel, back panel, two opposing side panels and top and bottom closures, said at least one recessing flap having a top edge, a bottom edge and two side edges, said at least one recessing flap being further formed from a depth-gauging panel, foldably emanating from an originating panel selected from one of the front panel, back panel, two opposing side panels, top closure and bottom closure along a selected edge of the top, bottom and two side edges of the recessing flap and a backing panel, foldably emanating from an interior edge of the depth-gauging panel disposed opposite from the selected edge of the at least one recessing flap to form a recessed cell in the carton which is at least partially separated from the interior region of the carton, at least one access panel disposed in, and foldably emanating from, one of the front panel, back panel, two opposing side panels, top closure and bottom closure, disposed adjacent to said originating panel, said at least one access panel further foldably emanating from an opposite edge of the backing panel;

the recessed cell spanning at least a portion of the originating panel and at least a portion of the at least one adjacent access panel to allow access to the recessed cell from outside the carton through at least two adjacent ones of said front panel, back panel, two opposing side panels, top closure and bottom closure;

a premium item for receipt within the recessed cell, the premium item likewise being accessible from at least two of said adjacent ones of said front panel, back panel, two opposing side panels, top closure and bottom closure, wherein the premium item includes an interactive element that may be manipulted without interfering with the interior region of the carton.

6. The container apparatus according to claim 5 wherein the interactive element requires access to said premium item housed within the recessed cell from both the originating panel side of the carton and the adjacent access panel side of the carton.

7. The container apparatus according to claim 5 wherein the interactive element further includes a viewing portion and a boundary exceeding member, said boundary exceeding member capable of manipulation for movement between a position substantially inside the recessed cell to a position substantially outside of the recessed cell.

8. The container apparatus according to claim 7 wherein the viewing portion of the interactive element is accessible through one of the originating panel and the adjacent access panel, while the boundary exceeding member is accessible through the other of the originating panel and the adjacent access panel.

9. A container apparatus for simultaneously housing a produce and a premium, said container apparatus comprising:

a carton including a front panel, a back panel and two opposing side panels defining an interior region, each of the front panel, back panel and two opposing side panels having top and bottom edges;

a top closure and a bottom closure for enclosing a product within the carton;

at least one recessing flap formed in at least one of the front panel, back panel, two opposing side panels and top and bottom closures, said at least one recessing flap having a top edge, a bottom edge and two side edges, said at least one recessing flap foldably emanating from an originating panel selected from at least one of the front panel, back panel, two opposing side panels, top closure and bottom closure long one of the top, bottom and two side edges of the recessing flap to form a recessed cell in the carton which is at least partially separated from the interior region of the carton, at least one access panel adjacent to said originating panel comprising at least one of said front panel, back panel, two opposing side panels, top closure and bottom closure;

the recessed cell spanning at least a portion of the originating panel and at least a portion of the at least one adjacent access panel to allow access to the recessed cell from outside the carton through at least two adjacent sides of the carton;

a premium item for receipt within the recessed cell, the premium item likewise being accessible from at least two sides of the carton;

wherein the premium item includes an interactive element that may be manipulated without interfering with the interior region of the carton;

wherein the interactive element further includes a viewing portion and a boundary exceeding member, said boundary exceeding member capable of manipulation for movement between a position substantially inside the recessed cell to a position substantially outside of the recessed cell.

10. The container apparatus according to claim 9 wherein the viewing portion of the interactive element is accessible through one of the originating panel and the adjacent access panel, while the boundary exceeding member is accessible through the other of the originating panel and the adjacent access panel.

11. A container apparatus for simultaneously housing a product and a premium, said container apparatus comprising:

a carton including a front panel, a back panel and two opposing side panels defining an interior region, each of the front panel, back panel and two opposing side panels having top and bottom edges;

a top closure and a bottom closure for enclosing a product within the caryton;

at least one recessing flap formed in at least one of the front panel, back panel, two opposing side panels and top and bottom closures, said at least one recessing flap having a top edge, a bottom edge and two side edges, said at least one recessing flap being further formed from a depth-gauging panel, foldably emanating from an originating panel selected from one of the front panel, back panel, two opposing side panels, top closure and bottom closure along a selected edge of the top, bottom and two side edges of the recessing flap and a backing panel, foldably emanating from an interior edge of the depth-gauging panel disposed opposite from the selected edge of the at least one recessing flap to form a recessed cell in the carton which is at least partially separated from the interior region of the carton, at least one access panel disposed in, and foldably emanating from, one of the front panel, back panel, two opposing side panels, top closure and bottom closure, disposed adjacent to said originating panel, said at least one access panel further foldably emanating from an opposite edge of the backing panel;

the recessed cell spanning at least a portion of the originating panel and at least a portion of the at least one adjacent access panel to allow access in the recessed cell from outside the carton through at least two adjacent ones of said front panel, back panel, two opposing side panels, top closure and bottom closure;

a premium item for receipt within the recessed cell, the premium item likewise being accessible from at least two of said adjacent ones of said front panel, back panel, two opposing side panels, top closure and bottom closure, wherein the premium item includes a tray for housing a promotional item, wherein the tray includes at least one flange for abutting at least a portion of at least one of the originating panel and the adjacent access panel to facilitate retention of the tray in the recessed cell, and wherein the gray further includes at least one side flap extending from the at least one flange for abutting the adjacent access panel to facilitate retention of the tray in the recessed cell.

12. A container apparatus for simultaneously housing a product and a premium, said container apparatus comprising:

a carton including a front panel, a back panel and two opposing side panels defining an interior region, each of the front panel, back panel and two opposing side panels having top and bottom sides;

a top closure and a bottom closure for enclosing a product within the carton;

at least one recessing flap formed in at least one of the front panel, back panel, two opposing side panels and top and bottom closures, said at least one recessing flap having a top edge, a bottom edge and two side edges, said at least one recessing flap being further formed from a depth-gauging panel, foldably emanating from an originating panel selected from one of the front panel, back panel, two opposing side panels, top closure and bottom closure along a selected edge of the top, bottom and two side edges of the recessing flap and a backing panel, foldably emanating from an interior edge of the depth-gauging panel disposed opposite from the selected edge of the at least one recessing flap to form a recessed cell in the carton which is at least partially separated from the interior region of the carton, at least one access panel disposed in, and foldably emanating from, one of the front panel, back panel, two opposing side panels, top closure and bottom closure, disposed adjacent to said originating panel, said at least one access panel further foldably emanating from an opposite edge of the backing panel;

the recessed cell spanning at least a portion of the originating panel and at least a portion of the at least one adjacent access panel to allow access to the recessed cell from outside the carton through at least two adjacent ones of said front panel, back panel, two opposing side panels, top closure and bottom closure;

a premium item for receipt within the recessed cell, the premium item likewise being accessible from at least two of said adjacent ones of said front panel, back panel, two opposing side panels, top closure and bottom closure, wherein at least one of the originating panel and the adjacent access panel include at least one push-in flap foldably attached thereto, said at least one push-in flap capable of orientation to further isolate the recessed cell from the interior region of the carton.

13. A container apparatus for simultaneously housing a product and a premium, sid container apparatus comprising:

a carton including a front panel, a back panel, and two opposing side panels defining an interior region, each of the front panel, back panel and two opposing side panels having top and bottom edges;

a top closure and a bottom closure for enclosing a product within the carton;

at least one recessing flap formed in at least one of the front panel, back panel, two opposing side panels and top and bottom closures, said at least one recessing flap having a top edge, a bottom edge and two side edges, said at least one recessing flap being further formed from a depth-gauging panel, foldably emanating from an originating panel elected from one of the front panel, back panel, two opposing side panels, top closure and bottom closure along a selected edge of the top, bottom and two side edges of the recessing flap and a backing panel, foldably emanating from an interior edge of the depth-gaugine panel disposed opposite from the selected edge of the at least one recessing flap to form a recessed cell in the carton which is at leat partially separated from the interior region of the carton, at least one access panel disposed in, and foldably emanating from, one of the front panel, back panel, two opposing side panels, top closure and bottom closure, disposed adjacent to said originating panel, said at least one access panel further foldably emanating from an opposite edge of the backing panel;

the recessed cell spanning at least a portion of the originting panel and at least a portion of the at least one adjacent access panel to allow access to the recessed cell from outside the carton through at least two adjacent ones of said front panel, back panel, two opposing side panels, top closure and bottom closure;

a premium item for receipt within the recessed cell, the premium item likewise being accessible from at least two of said adjacent ones of said front panel, back panel, two opposing side panels, top closure and bottom closure; and a packaging card for housing the premium item in the recessed cell.

14. The container apparatus according to claim 13 wherein the packaging card includes at least one flange for abutting at least a portion of at least one of the originating panel and the adjacent access panel for retaining the blister card in the recessed cell.

15. The container apparatus according to claim 13 wherein the packaging card is retained in the recessed cell by a friction fit.

16. The container apparatus according to claim 13 wherein the packaging card is adhered by an adhesive to at least one of the recessing panel, the originating panel and the adjacent access panel.

* * * * *